US008807095B2

(12) United States Patent
Takahashi et al.

(10) Patent No.: US 8,807,095 B2
(45) Date of Patent: Aug. 19, 2014

(54) ENGINE COOLING DEVICE

(75) Inventors: Daishi Takahashi, Susono (JP); Shinichiro Nogawa, Mishima (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 0 days.

(21) Appl. No.: 13/513,734

(22) PCT Filed: Dec. 4, 2009

(86) PCT No.: PCT/JP2009/070418

§ 371 (c)(1),
(2), (4) Date: Jun. 4, 2012

(87) PCT Pub. No.: WO2011/067857

PCT Pub. Date: Jun. 9, 2011

(65) Prior Publication Data

US 2012/0240877 A1 Sep. 27, 2012

(51) Int. Cl.
*F01P 7/00* (2006.01)

(52) U.S. Cl.
USPC ..... 123/41.02; 123/41.72; 123/41.17; 123/41.08

(58) Field of Classification Search
USPC ..... 123/41.02, 41.05, 41.08, 41.17, 41.67, 123/41.72
See application file for complete search history.

(56) References Cited

U.S. PATENT DOCUMENTS

| | | | | |
|---|---|---|---|---|
| 5,908,018 | A * | 6/1999 | Suzuki | 123/301 |
| 6,581,550 | B2 * | 6/2003 | Shinpo et al. | 123/41.74 |
| 2009/0007858 | A1 * | 1/2009 | Hochmayr et al. | 123/41.74 |
| 2009/0266315 | A1 * | 10/2009 | Hanai et al. | 123/41.72 |

FOREIGN PATENT DOCUMENTS

| | | | |
|---|---|---|---|
| DE | 101 96 371 | | 10/2003 |
| DE | 10 2004 049 292 | | 4/2006 |
| FR | 2 879 260 | | 6/2006 |
| JP | 62 98725 | | 6/1987 |
| JP | 2 50151 | | 4/1990 |
| JP | 6 323137 | | 11/1994 |
| JP | 8 218873 | | 8/1996 |
| JP | 2001 152850 | | 6/2001 |
| JP | 2001 152960 | | 6/2001 |
| JP | 2004 270652 | | 9/2004 |
| JP | 2009 197664 | | 9/2009 |
| JP | 2009197664 | A * | 9/2009 |

OTHER PUBLICATIONS

Machine Translation of JP2009197664A, see "JP2009197664A_Translation.pdf".*
International Search Report Issued Feb. 9, 2010 in PCT/JP09/70418 Filed Dec. 4, 2009.
International Search Report issued on Feb. 9, 2010 in PCT/JP2009/070418 which was filed Dec. 4, 2009 (partial English translation).
German Office Action issued on Mar. 12, 2014 in corresponding German patent application No. 112009005419.6.

* cited by examiner

*Primary Examiner* — Noah Kamen
*Assistant Examiner* — Long T Tran
(74) *Attorney, Agent, or Firm* — Oblon, Spivak, McClelland, Maier & Neustadt, L.L.P.

(57) ABSTRACT

The cooling device is provided with an engine including a cylinder block, a cylinder head, and a W/J which is a single system as a whole and which causes coolant to flow from the cylinder block to the cylinder head. The W/J branches into first and second inner paths within the cylinder block, and joints together within the cylinder head. The first inner path is provided with an opening and closing valve for permitting and prohibiting the flow of the coolant based on the pressure of the coolant.

6 Claims, 14 Drawing Sheets

ENGINE COOLING DEVICE

TECHNICAL FIELD

The present invention relates to an engine cooling device.

BACKGROUND ART

Conventionally, an engine is generally cooled by coolant. It is also known to increase the heat load, in particular, on a cylinder head during the engine driving state.

In this regard, for example, Patent Document 1 discloses an engine cooling device that accelerates the warming up the engine cold state and is capable of suitably cooling the engine in the engine warm state.

Specifically, this cooling cooling device accelerates the warm up by causing the coolant to flow through the cylinder head and the cylinder block in this order without causing the coolant to flow through a radiator in the engine cold state. That is, the engine cooling device accelerates the warming up in the engine cold state in such a manner that utilizes the high heat load on the cylinder head.

Further, in the engine warm state, this engine cooling device causes the coolant to flow through the cylinder head (or the radiator and the cylinder head in this order if necessary) in the low load state, and causes the coolant to flow through the radiator, the cylinder head, and the cylinder block in this order in the high load state. Therefore, the engine cooling device is supposed to suitably cool the engine. That is, this engine cooling device preferentially cools the cylinder head on which the high heat load is imposed, and is then supposed to suitably ensure the cooling in the engine warm state.

PRIOR ART DOCUMENT

Patent Document

[Patent Document 1] Japanese Patent Application Publication No. 2004-270652

SUMMARY OF THE INVENTION

Problems to be Solved by the Invention

Incidentally, an engine, in particular, a spark-ignited internal combustion engine generates much heat which is caused by an exhaust loss or a cooling loss and which is not used for the net work, as illustrated in FIG. 13. It is very important to reduce the cooling loss having a big ratio in the whole energy loss for the improvement of the heat efficiency (the mileage). However, it is not always easy to reduce the cooling loss and to use heat effectively. This prevents the improvement of the heat efficiency.

The reason why it is difficult to reduce the cooling loss is that, for example, a general engine cannot partially change the heat transfer state. That is, it is difficult to cool a part necessary to be cooled by the only the necessary degree, in consideration of the structure of the general engine by only a necessary degree. Specifically, in order to change the heat transfer state of the engine, the flow rate of the coolant is changed based on the engine rotational speed by a mechanical water pump driven by the output of the engine. However, even if the adjustable water pump changing the flow rate is used as the water pump entirely adjusting the flow rate of the coolant, the heat transfer state cannot be partially changed based on the engine driving state.

Also, for example, it is conceivable to increase the heat insulation of the engine in order to reduce the cooling loss. In this case, a large reduction in the cooling loss can be expected as illustrated in FIG. 14. However, in this case, an increase in the heat insulation also increases the inner wall temperature of the combustion chamber. In this case, this increases the temperature of the air-fuel mixture to cause a problem of knocking.

Thus, the present invention has been made in view of the above circumstances and has an object to provide an engine cooling device that partially changes a heat transfer state of an engine in a reasonable manner to reduce a cooling loss and to further satisfy both of a reduction in the cooling loss and property of knocking.

Means for Solving the Problems

In order to overcome the above problem, an aspect of the present invention is an engine cooling device including an engine provided with a cylinder block, a cylinder head, and a cooling medium flow passage which is a single system as a whole and which causes a cooling medium to flow from the cylinder block to the cylinder head, wherein the cooling medium flow passage branches into at least two inner paths within the cylinder block, and the inner paths joint together within the cylinder head, a flow changing portion is provided at least one of the inner paths, and is capable of changing a flow state of the cooling medium of based on a temperature of the cylinder head or a state quantity that can be used for estimating an increase in the temperature of the cylinder, and the flow changing portion increases a flow rate of the cooling medium, when the temperature of the cylinder head is higher than a first predetermined temperature or when the state quantity indicates that the temperature of the cylinder head can be higher than the first predetermined temperature.

Preferably, in the present invention, the flow changing portion may be a switching portion that is capable of changing a flow state of the cooling medium by permitting or prohibiting flow of the cooling medium based on the temperature of the cylinder head or the state quantity, and the switching portion may permit the flow of the cooling medium, when the temperature of the cylinder head is higher than the first predetermined temperature or when the state quantity indicates that the temperature of the cylinder head can be higher than the first predetermined temperature.

Preferably, in the present invention, the flow changing portion may be a switching portion that is capable of permitting or prohibiting the flow of the cooling medium based on a pressure of the cooling medium as the state quantity, a cooling medium pressure-feeding portion may be capable of changing the flow rate of the cooling medium that is pressure-fed, and a control portion may control the cooling medium pressure-feeding portion to increase the flow rate of the cooling medium pressure that is pressure-fed as the temperature of the cylinder head is higher, based on the temperature of the cylinder head.

Preferably, the present invention may further include a warning portion configured to perform control for outputting a warning of abnormality, when the temperature of the cylinder head is higher than a second predetermined temperature which is higher than the first predetermined temperature.

Preferably, in the present invention, the control portion may be configured to perform flow rate increase control for controlling the cooling medium pressure-feeding portion to increase the flow rate of the cooling medium that is pressure-fed, when the temperature of the cylinder head is higher than a second predetermined temperature which is higher than the first predetermined temperature, and a warning portion may be provided to be configured to perform control for outputting a warning of abnormality, when the temperature of the cylinder head is not lower than the second predetermined temperature after the control portion performs the flow rate increase control.

Preferably, the present invention may further include an output limiting portion configured to perform control for limiting an output of the engine, when the temperature of the cylinder head is not lower than the second predetermined temperature after the control portion performs the flow rate increasing control.

Preferably, in the present invention, the engine may use alcohol mixed fuel, the flow changing portion may be configured to be electrically controlled when changing the flow state of the cooling medium, a flow control portion may be provided for controlling the flow changing portion based on the state quantity when changing the flow state of the cooling medium, and a setting portion may be provided for setting the first predetermined temperature to be higher as a density of alcohol of the alcohol mixed fuel is higher.

Preferably, in the present invention, the cooling medium flow passage may be provided such that an exhaust side is cooled in preference to an intake side of the cylinder block, the cooling medium flow passage may branch from a downstream side of at least at the exhaust side in the cylinder block, and the flow changing portion may be provided in the inner path including its portion provided at the intake side in the cylinder block.

Effects of the Invention

According to the present invention, the heat transfer state of the engine is partially changed in a reasonable manner to reduce a cooling loss and to further satisfy both of a reduction in the cooling loss and property of knocking.

BRIEF DESCRIPTION OF THE DRAWINGS

FIG. 14 illustrates a general engine, as an usual configuration, provided with a coolant circulation passage of one system through which coolant flows from a cylinder block lower portion to a cylinder head against gravitational force.

MODES FOR CARRYING OUT THE INVENTION

Embodiments according to the present invention will be described in detail with reference to drawings.

(First Embodiment)

Figure 1:
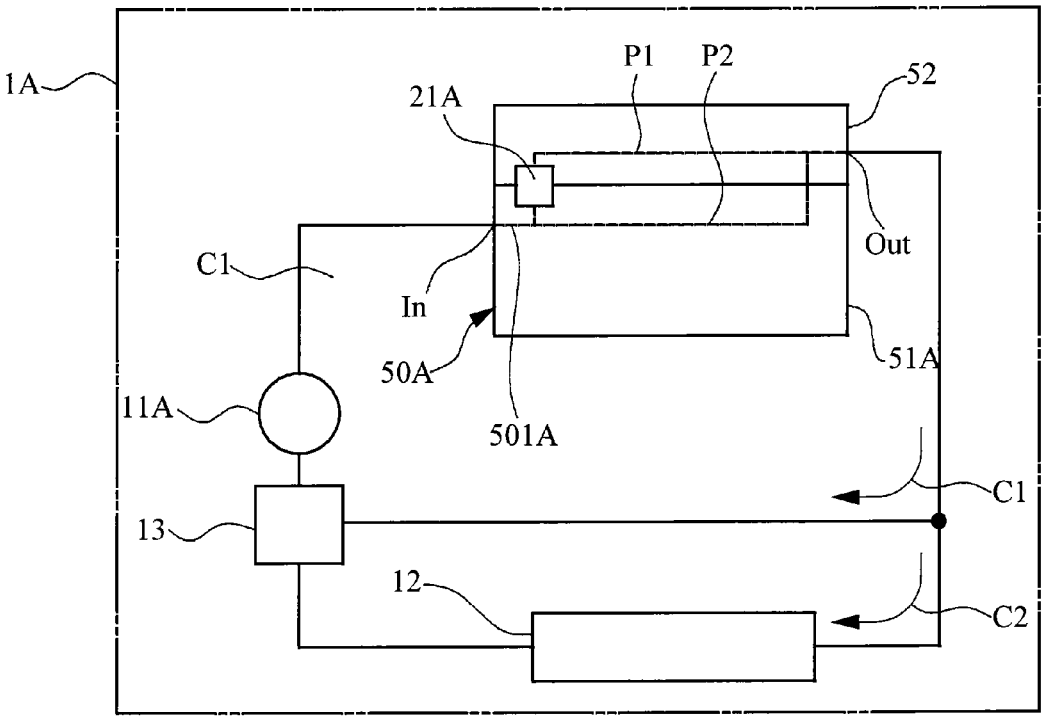
FIG. 1 is a schematic view of an engine cooling device (hereinafter, simply referred to as cooling device) 1.

A cooling device 1 illustrated in FIG. 1 is mounted on a vehicle not illustrated, and is provided with a water pump (hereinafter referred to as W/P) 11A, a radiator 12, a thermostat 13, an opening and closing valve 21A, and an engine 50A. The W/P 11A corresponds to a cooling medium pressure-feeding portion, and pressure-feeds the coolant as the cooling medium. The W/P 11A is a mechanical W/P driven by the output of the engine 50A. The coolant pressure-fed by the W/P 11A is supplied to the engine 50A.

The engine 50A is provided with a cylinder block 51A and a cylinder head 52. The engine 50A is provided with a water jacket (hereinafter referred to as W/J) 501A as a cooling medium passage which is a single system as a whole and which causes the coolant from the cylinder block 51A to the cylinder head 52. Specifically, the W/J 501A is provided at the cylinder block 51A with a single coolant inlet portion In and at the cylinder head 52 with a single coolant outlet portion Out. Also, the coolant is introduced from the coolant inlet portion In, and the coolant is discharged from the coolant outlet portion Out. Thus, the W/J is a single system as a whole and causes the coolant to flow from the cylinder block 51A to the cylinder head 52.

Figure 2:
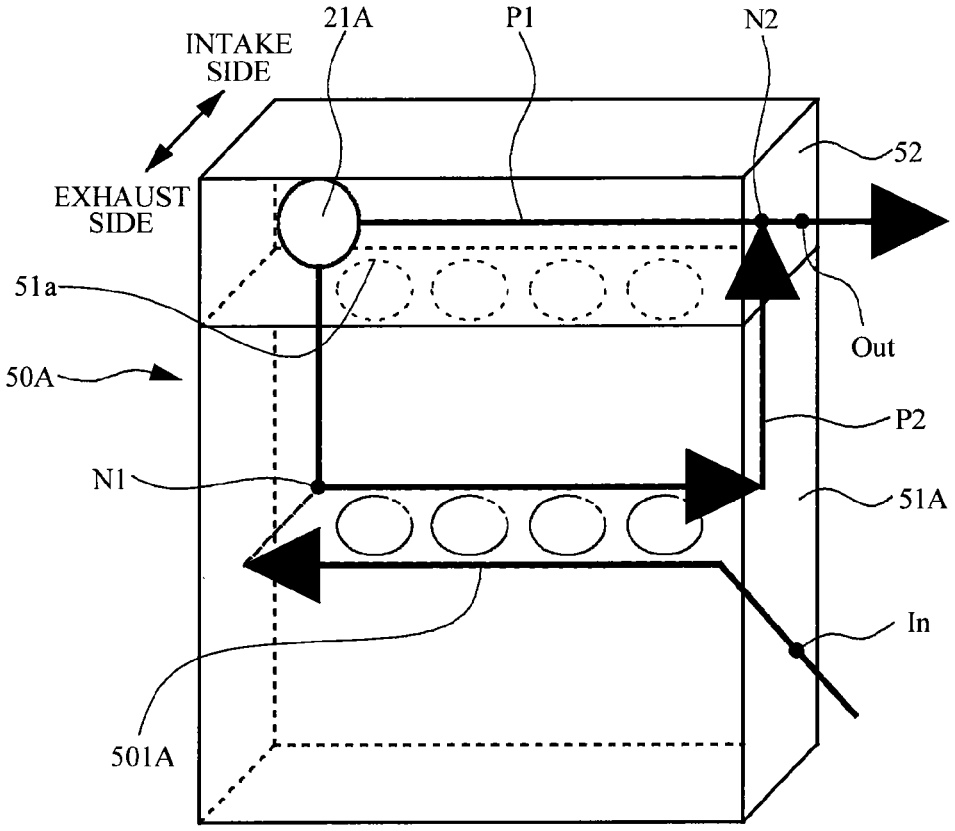
FIG. 2 is a schematic view of a W/J 501A.

The W/J 501A branches into two inner paths of a first inner path P1 and a second inner path P2 within the cylinder block 51A, and they joint together within the cylinder head 52. Specifically, the W/J 501A is provided around cylinders 51*a* so as to cool an exhaust side in preference to an intake side in the cylinder block 51A as illustrated in FIG. 2. Here, the W/J 501A is provided such that the exhaust side thereof is arranged on an upstream side as compared with the intake side thereof. A branching point N1 of the first and second inner paths P1 and P2 is provided at least on the downstream side of the exhaust side of the W/J 501A in the cylinder block 51A. Specifically, the first and second inner paths P1 and P2 of the W/J 501A branch off on the upstream side of the intake side of the W/J 501A in the cylinder block 51A. On the other hand, a jointing point N2 of the first and second inner paths P1 and P2 is provided in the W/J 501A in the cylinder head 52 in the vicinity of the coolant outlet portion Out.

Thus, the first inner path P1 includes a portion, of the W/J 501A, formed in the cylinder head 52, except for another portion in the vicinity of the coolant outlet portion Out. In this regard, the first inner path P1 is an inner path capable of cooling at least the cylinder head 52 of the cylinder block 51A and the cylinder head 52. On the other hand, the second inner path P2 is an inner path capable of introducing the coolant, which has flowed through at least the exhaust side of the cylinder block 51A provided to be preferentially cooled, into the coolant outlet portion Out.

The first inner path P1 is provided with the opening and closing valve 21A. The opening and closing valve 21A corresponds to a flow changing portion that is capable of changing the flow state of the coolant, and specifically corresponds to a switching portion. Specifically, the opening and closing valve 21A is a reed valve which has a built-in spring and which mechanically permits and prohibits the flow of the coolant based on a pressure thereof. More specifically, the opening and closing valve 21A permits the flow of the coolant to increase the flow rate thereof, when the pressure of the coolant indicates that the temperature of the cylinder head 52 can be higher than a first predetermined temperature.

In this regard, the pressure of the coolant increases as the flow rate of the coolant discharged from the W/P 11A increases, and the flow rate of the coolant discharged from the W/P 11A increases as the rotational speed of the engine 50A increases. Also, the temperature of the cylinder head 52 increases as the rotational speed of the engine 50A increases. Therefore, the pressure of the coolant is a state quantity capable of being used for estimating an increase in the temperature of the cylinder head 52. Also, specifically, the first predetermined temperature is a temperature for ensuring the reliability of the cylinder head 52. In this regard, a case where the pressure of the coolant indicates that the temperature of the cylinder head 52 can be higher than the first predetermined temperature, corresponds to, specifically, a case where the rotational speed of the engine 50A is the lowest rotational speed (hereinafter referred to as head heat insulation upper limit rotational speed) of rotational speeds respectively corresponding to the driving states of the engine 50A when it is necessary to ensure the reliability of the cylinder head 52 by causing the coolant to flow through the cylinder head 52.

On the other hand, the opening and closing valve 21A also serves as a cooling ability adjusting portion that is capable of adjusting the cooling ability of the cylinder head 52. In this regard, the opening and closing valve 21A serves as a cooling ability adjusting portion capable of suppressing the cooling ability of the cylinder head 52 without suppressing the cooling ability of the cylinder block 51A. Further, the opening and closing valve 21A provided in such a way serves as a cooling ability adjusting portion capable of adjusting the flow rate of the coolant flowing through the second inner path P2 so as to enhance the cooling ability of the cylinder block 51A when the opening and closing valve 21A adjusts the flow rate of the coolant flowing through the first inner path P1 so as to suppress the cooling ability of the cylinder head 52.

Returning to FIG. 1, plural coolant circulation passages are provided in the cooling device 1. For example, the coolant circulation passages include a circulation passage C1 not passing through the radiator 12 and a circulation passage C2 passing through the radiator 12. After the coolant flowing through the cooling device 1A is discharged from the W/P 11A, the coolant flows into the circulation path C1 through the thermostat 13 and into the circulation path C2 through the radiator 12 and the thermostat 13, and then returns to the W/P 11A. The radiator 12 is a heat exchanger, and exchanges heat between the flowing coolant and air in order to cool the coolant. The thermostat 13 switches flow passages communicating with the inlet side of the W/P 11A. Specifically, the thermostat 13 permits the flow passage bypassing the radiator 12 to be in a communication state, when the coolant temperature is lower than a predetermined value. The thermostat 13 permits the flow passage communicating with the radiator 12 to be in a communication state, when the coolant temperature is the predetermined value or more.

Figure 3:
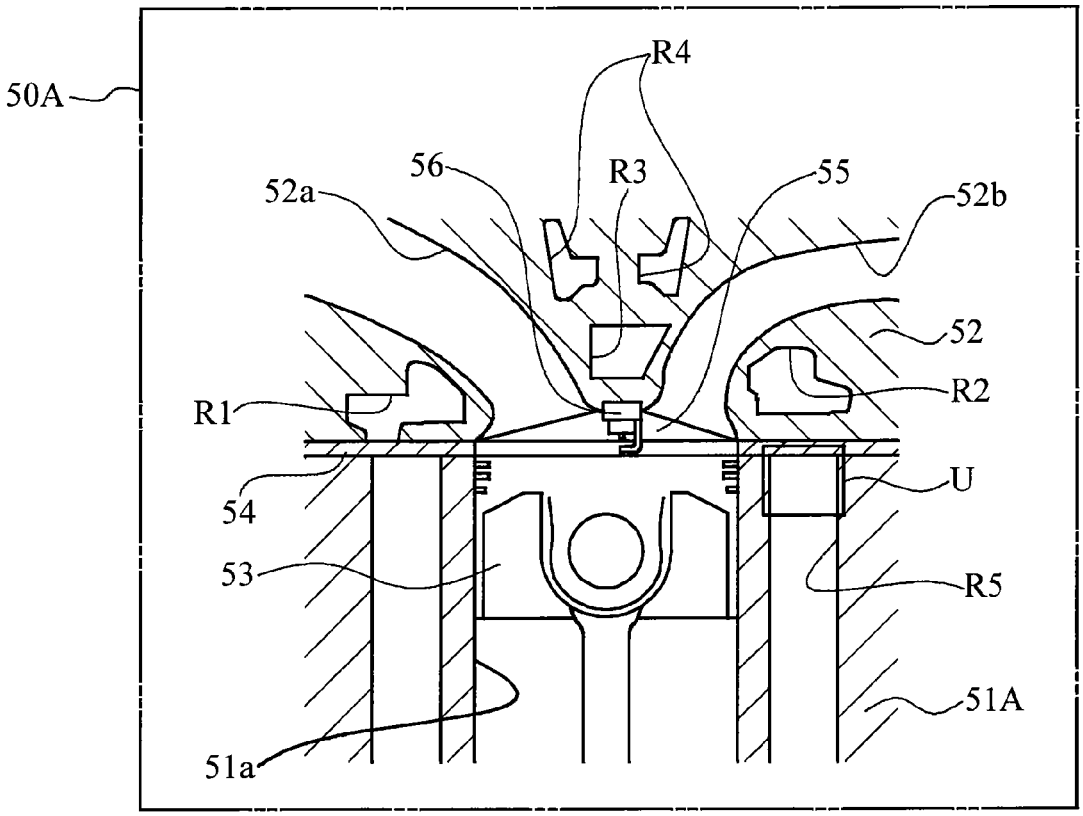
FIG. 3 is a schematic view of a cross section of a cylinder of an engine 50.

Next, the engine 50 will be explained in more detail. As illustrated in FIG. 3, the cylinder block 51 is provided with the cylinders 51*a*. The cylinder 51*a* is provided with a piston 53. The cylinder head 52 is fixed to the cylinder block 51 through a gasket 54 having a high heat insulation. The gasket 54 has a high heat insulation to suppress the heat transfer from the cylinder block 51A to the cylinder head 52. The cylinder 51*a*, the cylinder head 52 and the piston 53 define a combustion chamber 55. The cylinder head 52 is provided with an intake port 52*a* introducing the intake air to the combustion chamber 55 and an exhaust port 52*b* exhausting the combustion gas from the combustion chamber 55. A spark plug 56 is provided in the cylinder head 52 so as to substantially face the substantially central upper side of the combustion chamber 55.

Specifically, the W/J 501A, as a first partial cooling medium passage provided in the cylinder head 52, includes multiple parts of a partial W/J R1, a partial W/J R2, a partial W/J R3, and a partial W/J R4. The partial W/J R1, the partial W/J R2, the partial W/J R3 are respectively provided in the vicinities of the intake port 52*a*, the exhaust port 52*b*, and the spark plug 56. Also, the partial W/J R4 is provided for cooling between the intake port 52*a* and the exhaust port 52*b*, and another portion. These partial W/Js R1 to R4 are incorporated into the first inner path P1.

Also, the W/J 501A, as a second partial cooling medium passage provided in the cylinder block 51A, is provided with a partial W/J R5. Specifically, the partial W/J R5 is provided in the vicinity of the cylinder 51*a*. An upstream portion U of the partial W/J R5 is provided to correspond to a portion, of a wall surface of the cylinder 51*a*, where is hit by the intake air that has flown into the cylinder. In the regard, the engine 50A generates a forward tumble flow in a cylinder in the present embodiment. The portion where is hit by the intake air that has flown into the cylinder, specifically, corresponds to the upper portion, at the exhaust side, of the wall surface of the cylinder 51*a*. Thus, the W/J 501A is provided to preferentially cool the upper portion of the wall surface of the cylinder 51*a* at the exhaust side. A portion, at the exhaust side, of the partial W/J R5 is provided before the first and second inner paths P1 and P2 branch off. Another portion, at the intake side, of the partial W/J R5 is incorporated into the second inner path P2.

Figure 4:
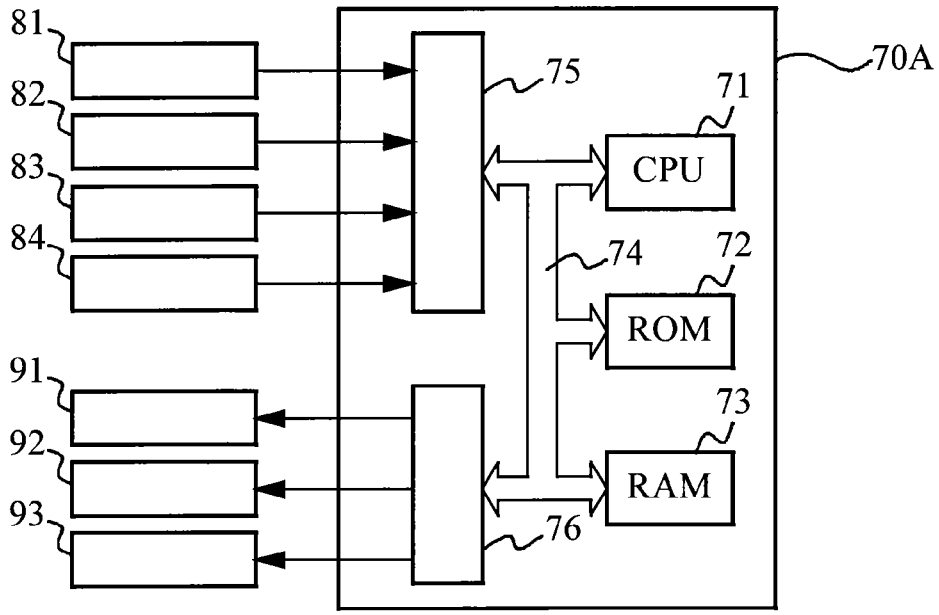
FIG. 4 is a schematic view of an ECU 70A.

Additionally, the cooling device 1A is provided with an Electronic Control Unit (ECU) 70 illustrated in FIG. 4 The ECU 70 includes a microcomputer of a CPU 71, a ROM 72, a RAM 73, and the like, and input-output circuits 75 and 76. These components are connected to each other via a bus 74. The ECU 70A is electrically connected with various sensors or switches such as a crank angle sensor 81 for detecting the rotational speed of the engine 50A, an air flow meter 82 for measuring the air intake amount, an accelerator opening sensor 83 for detecting an accelerator opening, and a water temperature sensor 84 for detecting the temperature of the coolant. In this regard, the ECU 70A detects the load on the engine 50A based on the outputs of the air flow mater 82 and the accelerator opening sensor 83. Also, the water temperature sensor 84 is provided in the vicinity of the coolant outlet portion Out, and the coolant temperature detected by the ECU 70A based on the output of the water temperature sensor 84 is detected as the water temperature in the cylinder head 52. The ECU 70A is electrically connected with various controlled objects such as an electronically-controlled throttle 91 for adjusting the intake air amount and a buzzer 92 and a warning light 93 for outputting a warning of abnormality.

The ROM 72 stores map data or programs about various kinds of processing performed by the CPU 71. The CPU 71 processes based on a program stored in the ROM 72 and uses a temporary memory area of the RAM 73 if necessary, whereby the ECU 70A functions as various portions such as a control portion, a determination portion, a detecting portion, and a calculating portion.

In this regard, for example, the ECU 70A functions as a warning portion that performs control for outputting a warning of abnormality when the temperature of the cylinder head 52 is higher than a second predetermined temperature higher than the first predetermined temperature. Specifically, the warning portion achieves to perform the control for outputting a warning of abnormality by performing the control for turning on the buzzer 92 and the warning light 93. Also, for example, the ECU 70A functions as an output limiting portion which limits the output of the engine 50A when the temperature of the cylinder head 52 is not lower than the second predetermined temperature after the warning portion performs the control for outputting the warning. Specifically, the output control portion is achieved to limit the output of the engine 50A by limiting the opening degree of the electronically-controlled throttle 91 when the temperature of the cylinder head 52 is not lower than the second predetermined temperature after a predetermined period T1 elapses from the time when the warning portion outputs the warning. Additionally, specific objects controlled by the warning portion and the output limiting portion are not limited to them.

Figure 5:
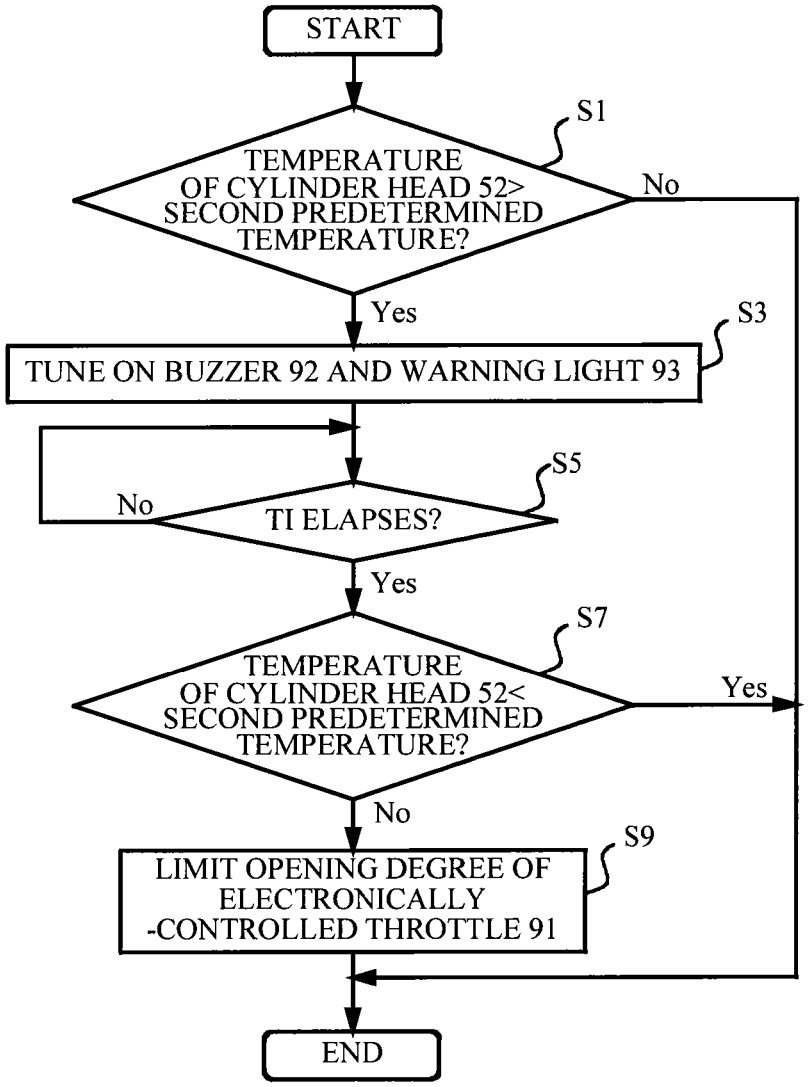
FIG. 5 is a schematic view of a flowchart of the operation of the ECU 70A.

The processing performed in the ECU 70 will be described with reference to a flowchart illustrated in FIG. 5. Additionally, this flow chart is repeated in a relatively short period in the engine driving state. The ECU 70A determines whether or not the temperature of the cylinder head 52 is higher than the second predetermined temperature (step S1). When the opening and closing valve 21A cannot be normally opened by some failure, the temperature of the cylinder head 52 is higher than the second predetermined temperature. In this regard, specifically, the second predetermined temperature is set to a temperature where the opening and closing valve 21A cannot be normally opened and where the engine 50A is not damaged. If a negative determination is made in step S1, this flow chart temporally ends because of unnecessary of special processing.

In contrast, if a positive determination is made in step S1, the ECU 70A turns on the buzzer 92 and the warning light 93 (step S3). Sequentially, the ECU 70A determines whether or not the predetermined period T1 elapses (step S5). If a negative determination is made, processing is repeated until the predetermined period T1 elapses. On the other hand, if a positive determination is made in step S5, the ECU 70A determines whether or not the temperature of the cylinder head 52 is lower than the second predetermined temperature (step S7). If a positive determination is made, this flow chart temporally ends. On the other hand, if a negative determination is made in step S7, the ECU 70A limits the opening degree of the electronically-controlled throttle 13 (step S9).

Figure 6:
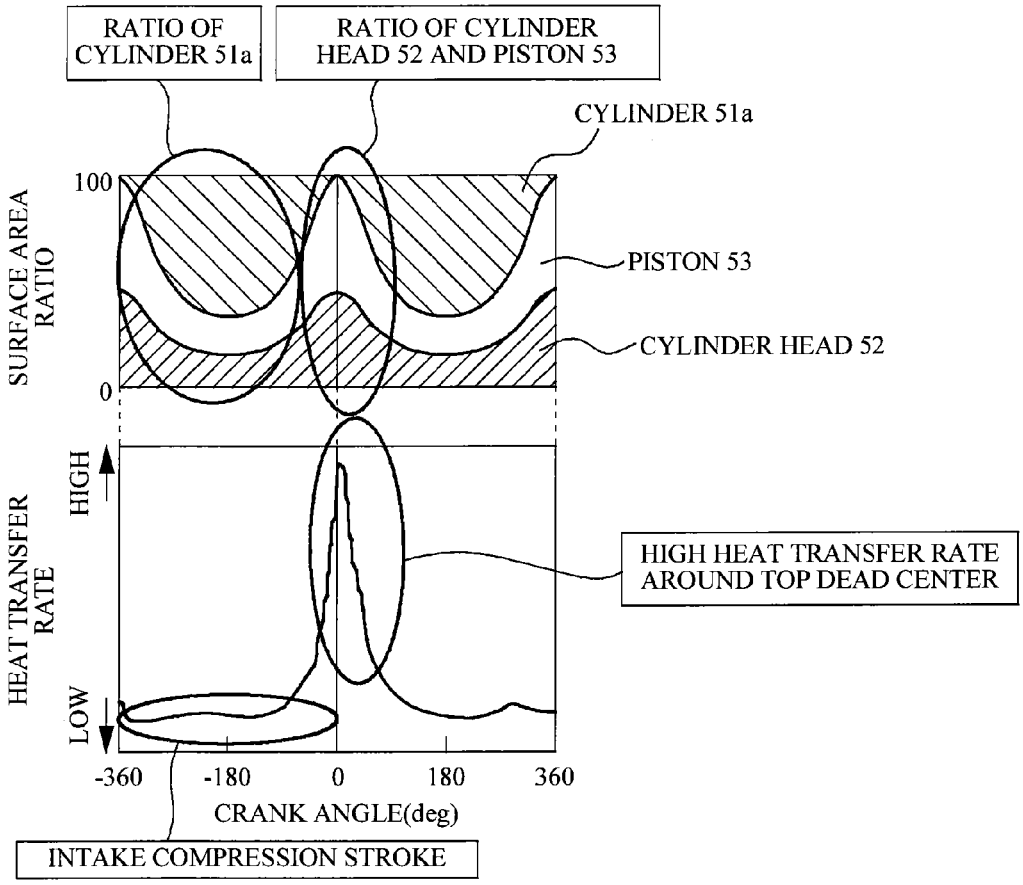
FIG. 6 is a schematic view of a heat transfer rate and a surface area ratio of a combustion chamber 55 based on a crank angle.

Next, effects of the cooling device 1A will be described. Herein, FIG. 6 illustrates heat transfer rates and surface area ratios of the combustion chamber 55 according to the crank angle of the engine 50. As illustrated in FIG. 6, the heat transfer rate rises around the top dead center in the compression stroke. The surface area ratio between the cylinder head 52 and the piston 53 rises around the top dead center in the compression stroke. It is thus found that the temperature of the cylinder head 52 greatly influences the cooling loss. On the other hand, knocking depends on the compression end temperature. It is seen that the surface area ratio of the cylinder 51*a* is great in the intake compression stroke which influences the compression end temperature. It is thus understood that the temperature of the cylinder 51*a* greatly influences knocking.

Figure 7:
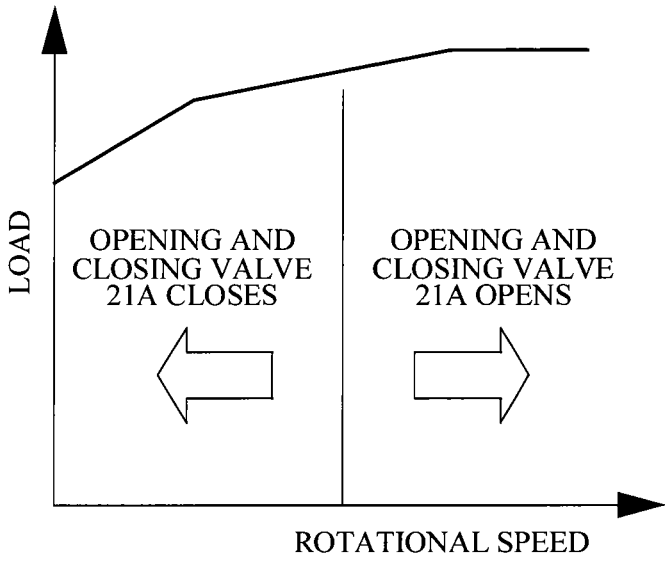
FIG. 7 is a view of a state of an opening and closing valve 21A based on a driving state of the engine 50A in a cooling device 1A.

In view of these findings, the cooling device 1A is provided with the opening and closing valve 21A. Further, the opening and closing valve 21A closes depending on the coolant pressure when the rotational speed of the engine 50A is middle or low as illustrated in FIG. 7, and opens based on the coolant pressure when the rotational speed is high. Therefore, the cooling device 1A reduces the cooling loss by suppressing the cooling ability of the cylinder head 52 in the middle or low rotational speed of the engine 50A. On the other hand, the generation of knocking is worried about in this case. In response to this, the opening and closing valve 21A is capable of suppressing the cooling ability of the cylinder head 52 without suppressing the cooling ability of the cylinder block 51A. For this reason, the cooling device 1A can maintain cooling of the cylinder 53*a*, thereby suppressing the knocking. That is, in the cooling device 1A, the heat transfer state is partially changed in a reasonable manner based on the above knowledge, thereby ensuring the heat insulation of the cylinder head 52 (reducing the cooling loss). Simultaneously, the cylinder block 51A is cooled to suppress the knocking. Also, in the cooling device 1A, the opening and closing valve 21A opens when the rotational speed of the engine 50A is high, thereby ensuring the reliability of the cylinder head 52. That is, the cooling device 1A ensures the driving of the engine 50A while reducing the cooling loss in such a way. This improves the heat efficiency in the entire driving state of the engine 50.

Also, the cooling device 1A is provided with the W/J 501A which cools the exhaust side portion, where the intake air introduced into the cylinder hits, in preference to the intake side portion of the cylinder block 51A. Thus, the cooling device 1A effectively cools the intake air to suitably suppress the knocking. In this regard, specifically, the cooling device 1A is provided with the W/J 501A so as to preferentially cool the upper portion, at the exhaust side, of the wall surface of the cylinder 51*a*. This more effectively cools the intake air to more suitably further suppress the knocking.

Also, in the cooling device 1A, the mechanical opening and closing valve 21A is used. If the opening and closing valve 21A cannot be normally opened by some failure, the buzzer 92 and the warning light 93 are turned ON. Thus, this cooling device 1A urges a user to decelerate or perform the evacuation driving. That is, in the cooling device 1A, even if the opening and closing valve 21A cannot be normally opened by any failure, the speed is reduced or the evacuation driving is performed by the user's intention. Thus, the cooling device 1A can prevent the running vehicle from falling into the dangerous situation caused by immediately limiting the output of the engine 50A. Also, the user actually decelerates or performs the evacuation driving to reduce the output of the engine 50A. Therefore, the cooling device 1A avoids the damage of the engine 50A while ensuring the safe driving of the vehicle.

In contrast, when the deceleration or the evacuation driving is not suitably performed or the deceleration is insufficient after the buzzer 92 and the warning light 93 are turned on, the temperature of the cylinder head 52 might not be lower than the second predetermined temperature in some cases. In correspondence to this, the cooling device 1A limits the opening degree of the electronically-controlled throttle 13 to certainly avoid the damage of the engine 50A. Additionally, in this case, when the electronically-controlled throttle 91 is larger than a target limit opening degree, for example, the electronically-controlled throttle 91 is controlled such that the opening degree of the electronically-controlled throttle 91 is gradually reduced to the target limit opening degree, thereby ensuring the safe driving of the vehicle as much as possible.

(Second Embodiment)

The cooling device 1B according to the present embodiment is substantially the same as the cooling device 1A, except that a W/P 11B changing the flow rate of the coolant pressure-fed is provided as a cooling medium pressure-feeding portion instead of the W/P 11A and an ECU 70B is provided instead of the ECU 70A. The ECU 70B is substantially the same as the ECU 70A, except that the W/P 11B as a controlled object is electrically connected thereto, a control portion is functionally achieved as will be described later, and a warning portion is achieved as will be described later. Therefore, the illustration of the cooling device 1B and the ECU 70B is omitted.

The control portion is achieved to control the W/P 11B such that the discharge amount of the coolant is larger as the temperature of the cylinder head 52 is higher, based on the temperature of the cylinder head 52. Thus, in the cooling device 1B, the discharge amount of the coolant from the W/P 11B, that is, the coolant pressure increases as the temperature of the cylinder head 52 increases. Additionally, this is a basic control tendency of the W/P 11B, and the W/P 11B may be controlled to appropriately increase or decrease the discharge amount if necessary. In this regard, the control portion is achieved to further perform the flow rate increase control for controlling the W/P 11B to increase the flow rate of the coolant pressure-fed when the temperature of the cylinder head 52 is higher than the second predetermined temperature.

On the other hands, in the ECU 70B, the warning portion is achieved to perform control for outputting the warning of abnormality when the temperature of the cylinder head 52 is not lower than the second predetermined temperature after the control portion performs the flow rate increase control. Specifically, the warning portion is achieved to perform control for tuning on the buzzer 92 and the warning light 93 when the temperature of the cylinder head 52 is not lower than the second predetermined temperature after a predetermined period T2 elapses from the time when the control portion performs the flow rate increase control.

Figure 8:
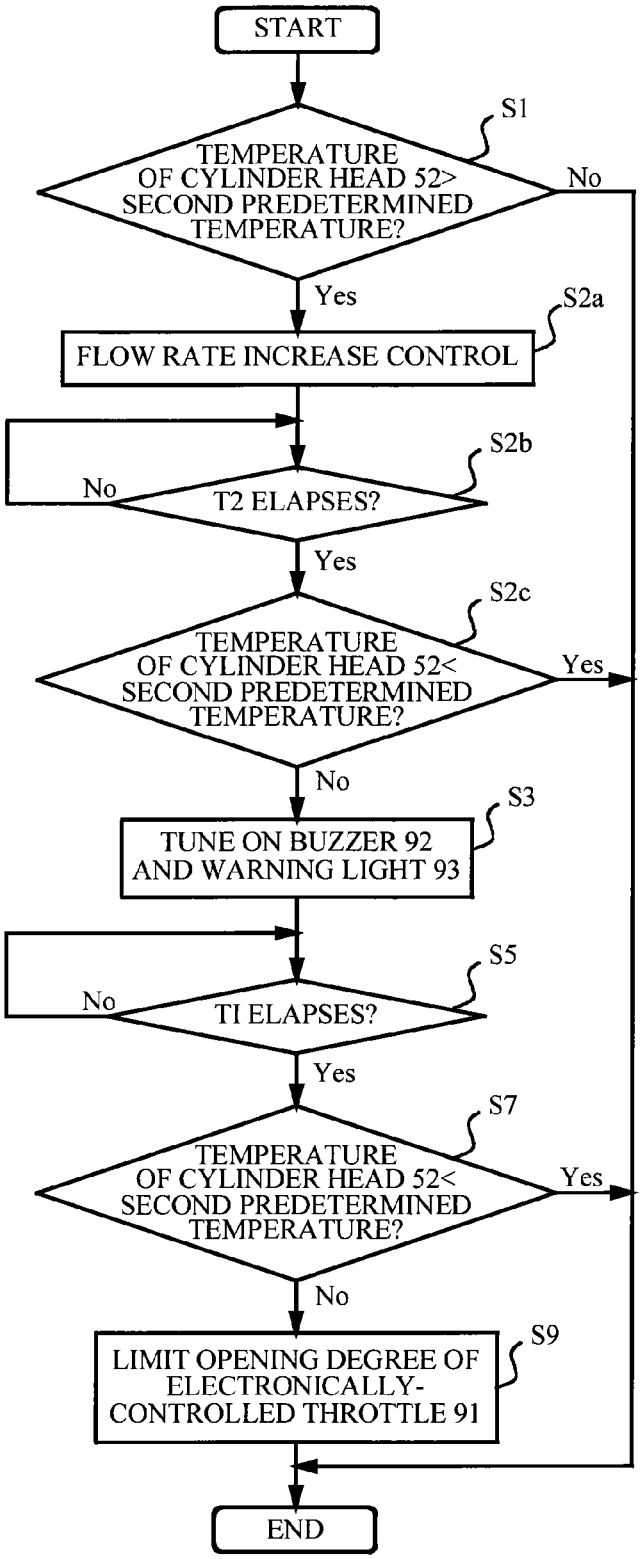
FIG. 8 is a schematic view of a flowchart of the operation of the ECU 70B.
Figure 9:
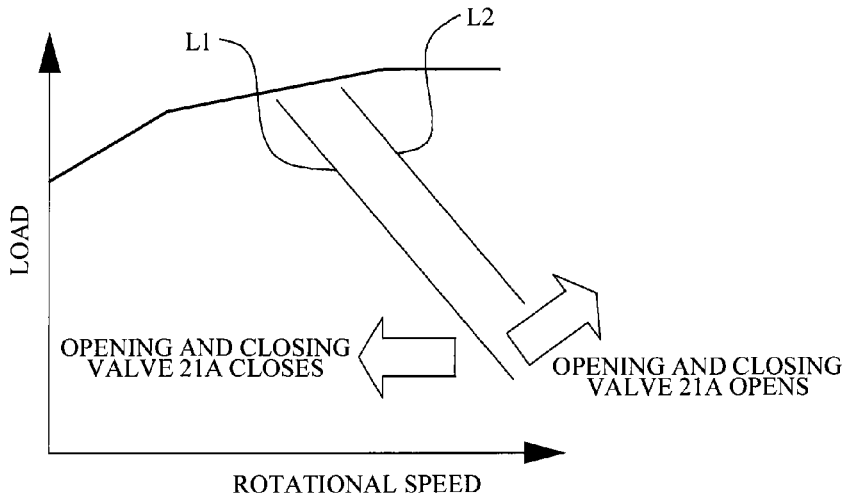
FIG. 9 is a view of the state of the opening and closing valve 21A based on a driving state of the engine 50A in a cooling device 1B.

The processing performed in the ECU 70B will be described with reference to a flowchart illustrated in FIG. 8. Additionally, the flow chart illustrated in FIG. 8 is the same as the flow chart illustrated in FIG. 5, except that steps S2*a*, S2*b*, and S2*c* are added. Thus, these steps will be explained here. When a positive determination is made in step S1, the ECU 70B performs the flow rate increase control (step S2*a*). Additionally, the W/P 11B is basically controlled to discharge the amount of the coolant based on the temperature of the cylinder head 52, when the flow rate increase control is not performed. Sequentially, the ECU 70B determines whether or not the predetermined period T2 elapses (step S2*b*). If a negative determination is made, the processing is repeated until the predetermined period T2 elapses. On the other hand, if a positive determination is made in step S2*b*, the ECU 70B determines whether or not the temperature of the cylinder head 52 is not lower than the second predetermined temperature (step S2*c*). Then, a positive determination is made, this flow chart is temporally finished. If a negative determination is made, processing goes to step S3.

Next, effects of the cooling device 1B will be described. Here, when the temperature of the cylinder head 52 is the first predetermined temperature in high-rotation and high-load state where it is necessary to ensure the reliability of the cylinder head 52, the opening and closing valve 21A in the cooling device 1B opens based on the coolant pressure corresponding to this temperature. Thus, in the cooling device 1B, when the driving state of the engine 50A in an engine warm state is in a high load region defined by a straight line L1, the opening and closing valve 21A opens, thereby ensuring the reliability of the cylinder head 52. Additionally, when the driving state is not in the above region, the opening and closing valve 21A closes, thereby reducing the cooling loss in the driving region broader than that of the cooling device 1A. Also, the driving state of the engine 50A, when the temperature of the cylinder head 52 reaches the first predetermined temperature, is changed based on the warm state of the engine 50A. In correspondence to this, in the cooling device 1B, the opening and closing valve 21A opens in the engine cold state when the driving state is in a more high rotation and high load driving region defined by a straight line L2, thereby reducing the cooling loss in the more broad driving region. The cooling device 1B can suitably reduce the cooling loss, as compared with the cooling device 1A.

Also, in the cooling device 1B, in a case where the opening and closing valve 21A cannot be normally opened by some failure, the flow rate increase control is firstly performed before the buzzer 92 and the warning light 93 are turned ON. In this case, as long as the opening and closing valve 21A opens more or less, the temperature of the cylinder head 52 can be reduced. Thus, the cooling device 1B is capable of avoiding the damage of the engine 50A without urging a user to reduce the speed or perform the evacuation driving. Therefore, it is possible to further avoid the damage of the engine 50A as compared with the cooling device 1A.

(Third Embodiment)

A cooling device 1C according to the present embodiment is substantially the same as the cooling device 1A, except that an engine 50B is provided instead of the engine 50A. Also, the engine 50B is substantially the same as the engine 50A, except that an opening and closing valve 21B is provided instead of the opening and closing valve 21A. Thus, the illustration of the cooling device 1C is omitted. The opening and closing 21B corresponds to a flow changing portion which changes the flow state of the coolant, specifically, further corresponds to a switching portion. The opening and closing valve 21B is a thermostat type of the opening and closing valve capable of mechanically permitting and prohibiting the flow of the coolant based on the temperature of the cylinder head 52. In this regard, the opening and closing valve 21B permits the flow of the coolant to increase the flow rate of the coolant when the temperature of the cylinder head 52 is higher than the first predetermined temperature.

Next, effects of the cooling device 1C will be described. Here, when the temperature of the cylinder head 52 is the first predetermined temperature in high rotation and high load state where it is necessary to ensure the reliability of the cylinder head 52, the opening and closing valve 21B in the cooling device 1C opens. Thus, like the cooling device 1B, the cooling device 1C further reduces the cooling loss in the more broader driving region in the engine warm state than that of the cooling device 1A. Also, like the cooling device 1B, the cooling device 1C further reduces the cooling loss in the more broader driving region in the engine cold state than that of the cooling device 1A.

For this reason, the cooling device 1C can more preferably reduce the cooling loss than the cooling device 1A. Also, the cooling device 1C may be achieved to be provided with the mechanical W/P 11A as a cooling medium pressure-feeding portion. Thus, the cooling device 1C has applicability and an advantage in cost, as compared with the cooling device 1B.

Additionally, for example, the W/P 11B and the ECU 70B instead of the W/P 11A and the ECU 70A are applicable to the cooling device 1C. That is, for example, the opening and closing valve 21B instead of the opening and closing valve 21A is applicable to the cooling device 1B. In this case, like the cooling device 1B, when an abnormality occurs in the opening and closing valve 21B, the damage of the engine 50B is suitably avoided, as compared with the cooling device 1A.

(Fourth Embodiment)

A cooling device 1D according to the present embodiment is substantially the same as the cooling device 1C, except that an engine 50C is provided instead of the engine 50A and an ECU 70C is provided instead of the ECU 70A. The engine 50C is substantially the same as the engine 50A, except that the engine 50C is capable of using alcohol mixed fuel as fuel and an opening and closing valve 21C described below is provided instead of the opening and closing valve 21A. The ECU 70C is substantially the same as the ECU 70A, except that an alcohol sensor (illustration omitted) as will be described is electrically connected to the ECU 70C, and a flow control portion and a setting portion are functionally achieved as will be described. Thus, the illustration of the cooling device 1D and the ECU 70C is omitted.

The opening and closing valve 21C corresponds to a flow changing portion capable of changing the flow of the coolant, more specifically, a setting portion. In this regard, the opening and closing valve 21C is configured to be electrically controlled to change the flow state of the coolant. The alcohol sensor is a sensor for detecting the alcohol density of the alcohol mixed fuel and is provided in a fuel tank, not illustrated, where the alcohol mixed fuel is retained. Specifically, for example, a sensor that detects an electric conductivity of the fuel changing based on the alcohol density is applicable to the alcohol sensor.

The flow control portion is achieved to control the opening and closing valve 21C based on the reasonable speed of the engine 50C as the state quantity that can be used for estimating an increase in the temperature of the cylinder head 52. Additionally, for example, the pressure of the coolant may be used instead of the rotational speed of the engine 50C. The flow control portion is achieved to control the opening and closing valve 21C such that the flow of the coolant is permitted or prohibited based on the rotational speed of the engine 50C. More specifically, the flow control portion is achieved to control the opening and closing valve 21C such that the flow rate of the coolant is increased at the time when the temperature of the cylinder head 52 can be higher than the first predetermined temperature. The case where the temperature of the cylinder head 52 can be higher than the first predetermined temperature is, specifically, a case where the rotational speed of the engine 50C is a head heat insulation upper limit rotational speed.

The setting portion is achieved to set the first predetermined temperature to be higher as the alcohol density of the alcohol mixed fuel is higher, according to the output from the alcohol sensor. Specifically, the setting portion is achieved to set the head heat insulation upper limit rotational speed to be higher as the alcohol density of the alcohol mixed fuel is higher, by setting the first predetermined temperature to be higher as the alcohol density of the alcohol mixed fuel is higher, based on the output from the alcohol sensor. Specifically, the alcohol mixed fuel is the ethanol mixed fuel.

Figure 10:
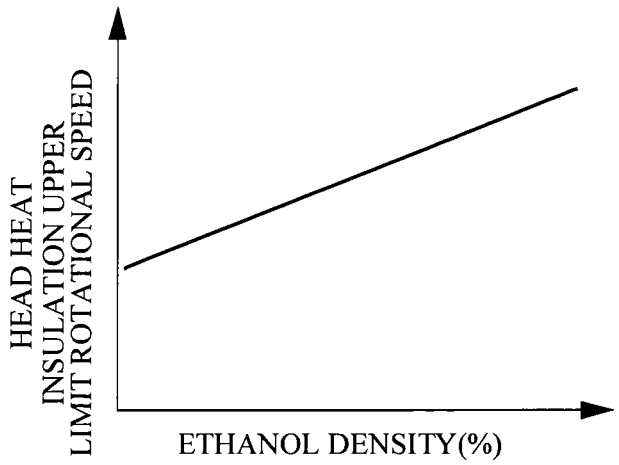
FIG. 10 is a view of a relationship between an ethanol density of an ethanol mixed fuel and a head heat insulation upper limit rotational speed.
Figure 11:
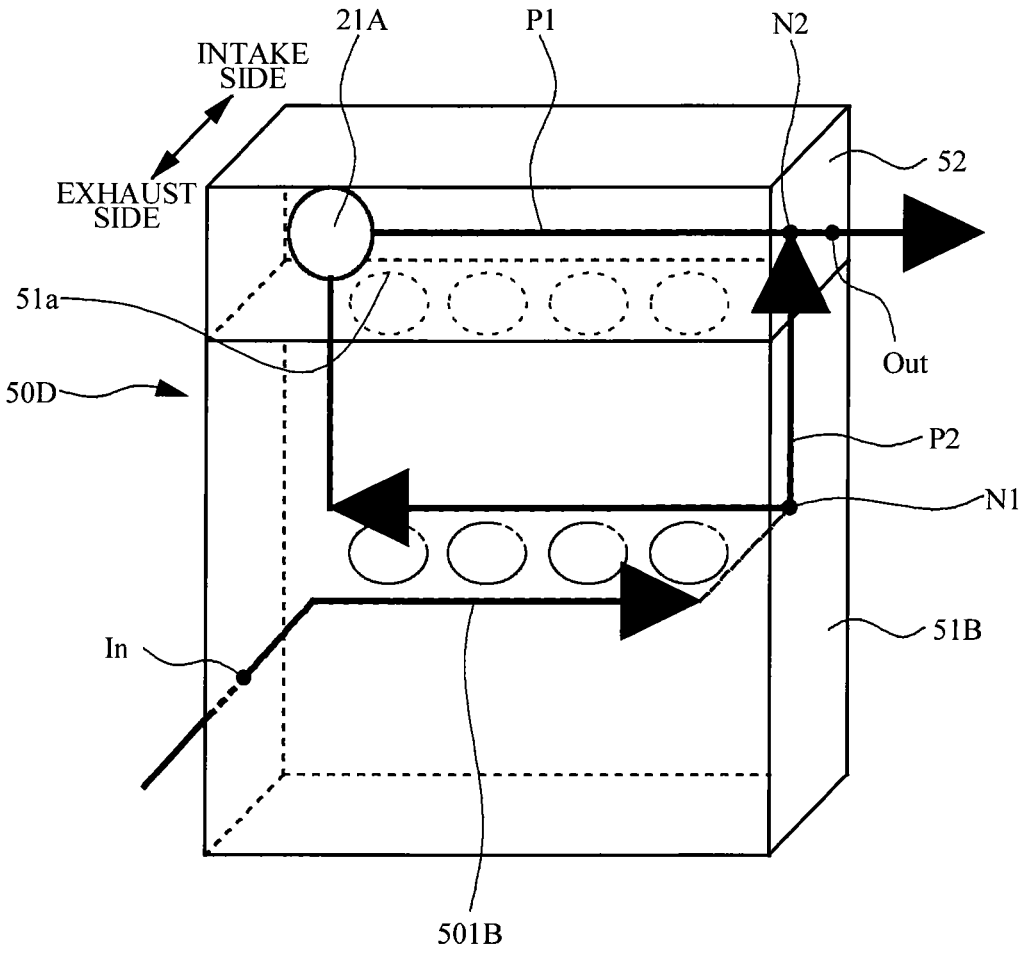
FIG. 11 is a schematic view of a W/J 501B.

Next, effects of the cooling device 1D will be described. Herein, in the engine 50C, the temperature of the cylinder head 52 decreases based on the ethanol density, by the latent heat effect in vaporization of the ethanol mixed fuel. Thus, in the cooling device 1D, the head heat insulation upper limit rotational speed corresponding to the first predetermined temperature is different based on the ethanol density. Specifically, as illustrated in FIG. 10, the head heat insulation upper limit rotational speed corresponding to the first predetermined temperature is higher as the ethanol density of the ethanol mixed fuel is higher. In response thereto, in the cooling device 1D, the head heat insulation upper limit rotational speed is set to be higher as the ethanol density is higher. Therefore, the cooling device 1D reduces the cooling loss in the driving region broader than that in the cooling device 1A.

(Fifth Embodiment)

Figure 12:
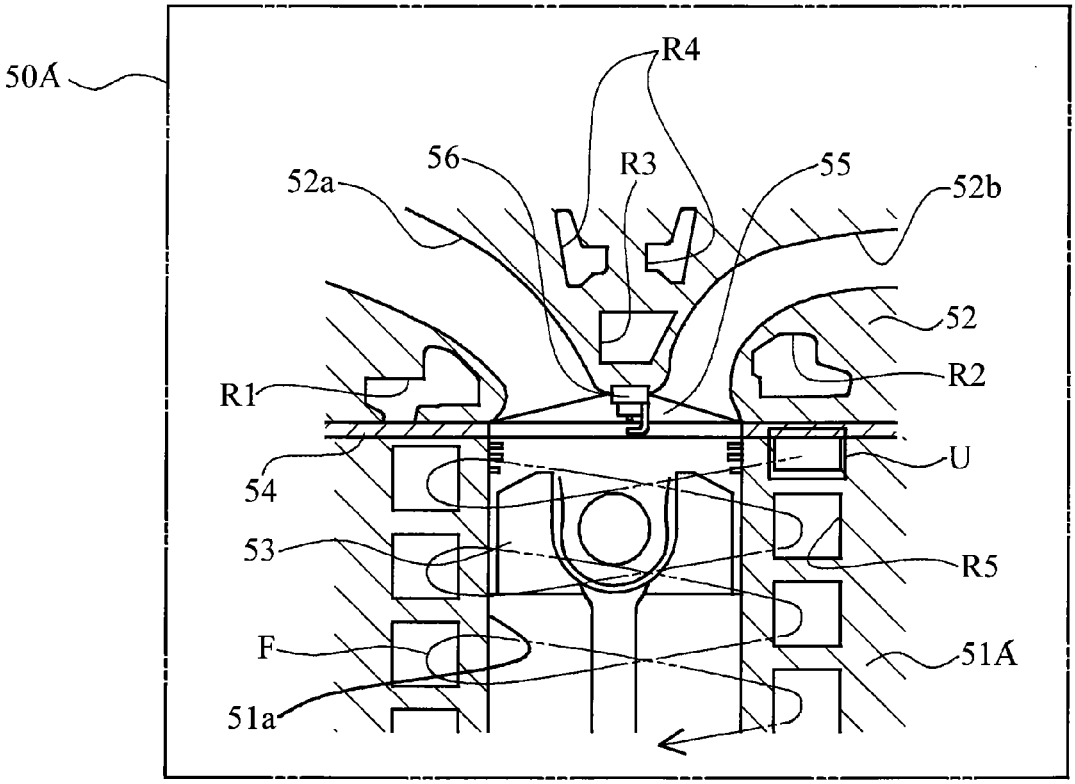
FIG. 12 is a schematic view of a variation of a cooling medium passage, in which an engine 50A' illustrated in FIG. 13 is also substantially the same as an engine 50A, except that a cylinder block 51A' and a partial W/J R5 having a spiral shape are provided instead of a cylinder block 51A and a branch manner of the cooling medium passage is different, and an arrow F schematically indicates the flow of the coolant.

A cooling device 1E according to the present embodiment is substantially the same as the cooling device 1A, except that an engine 50D is provided instead of the engine 50A. Thus, the illustration of the cooling device 1E is omitted. The engine 50D is substantially the same as the engine 50A as illustrated in FIG. 12, except that a W/J 501B is provided instead of the W/J 501A, in response thereto, a cylinder block 51B is provided instead of the cylinder block 51A. Additionally, the above variation is applicable to the cooling devices 1B, 1C and 1D.

The W/J 501B is substantially the same as the W/J 501A, except that the first inner path P1 provided with the opening and closing valve 21A further includes a portion of the W/J 501B at the intake side in the cylinder block 51B. That is, the W/J 501B is provided such that the portion of the W/J 501B at the intake side in the cylinder block 51B is included in the first inner path P1 provided with the opening and closing valve 21A, in contrast to the W/J 501A.

Next, effects of the cooling device 1E will be described. In the cooling device 1E, as compared to the cooling device 1A, the opening and closing valve 21A is provided in the first inner path P1 including the portion of the W/J 501B at the intake side in the cylinder block 51B. Therefore, the cooling device 1E further reduces the cooling loss at the intake side while the opening and closing valve 21A is closing, as compared with the cooling device 1A. On the other hand, in this case, the cooling ability of the cylinder block 51B is partially suppressed when the opening and closing valve 21A closes. In correspondence thereto, the cooling device 1E cools the exhaust portion of the cylinder block 51B even when the opening and closing valve 21A closes. For this reason, the cooling device 1E suppresses the knocking while further reducing the cooling loss in this way.

While the exemplary embodiments of the present invention have been illustrated in detail, the present invention is not limited to the above-mentioned embodiments, and other embodiments, variations and modifications may be made without departing from the scope of the present invention.

For example, in the above embodiments, the description has been given of each opening and closing valve 21 corresponding to the flow changing portion. However, the present invention is not limited to this. For example, the flow changing portion may be a valve that relatively increase the flow rate between two states. In this regard, the flow changing portion may be a flow rate control valve configured to be electrically controlled. Also, a flow control portion may be provided for controlling the flow changing portion based on the temperature of the cylinder head or the state quantity which can be used for estimating an increase in the temperature of the cylinder head, in order to change the flow state of the cooling medium. Also, in this case, the flow rate control valve may function as the switching portion.

In this regard, in the above embodiment, for example, the description has been given of the opening and closing valves 21A and 21B corresponding to mechanical switching portions in consideration of the advantage in cost. However, the present invention is not limited to this. Like the above flow changing portion, the switching portion may be configured to be electrically controlled.

Figure 13:
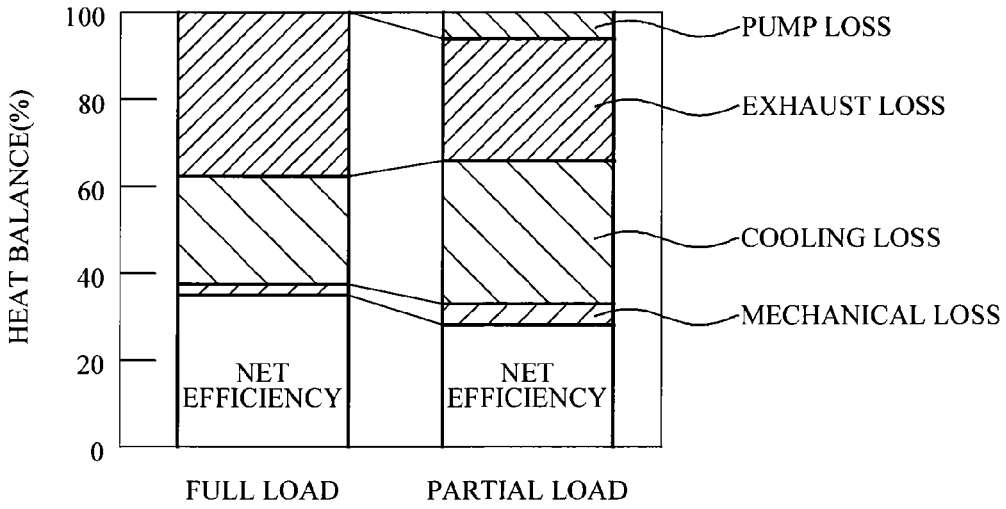
FIG. 13 is a view of items of the general heat balance of a spark-ignited internal combustion engine in each case of full load and partial load.
Figure 14:
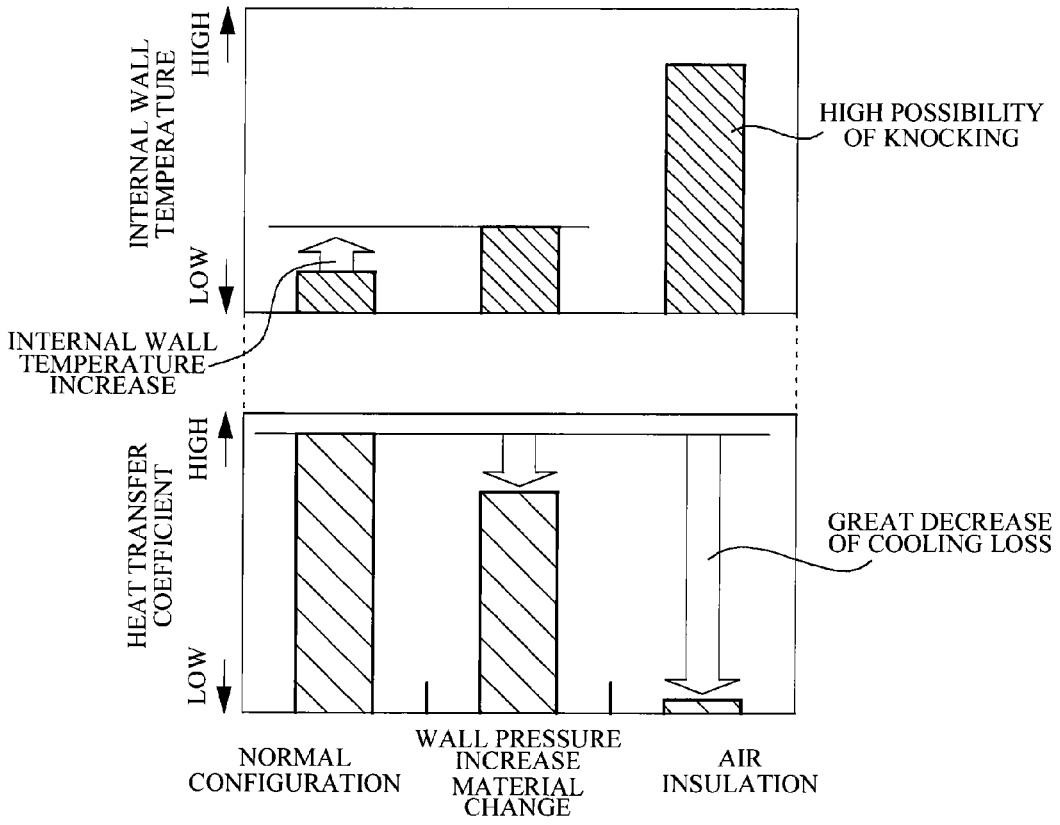
FIG. 14 is a view of an inner wall temperature and a heat transmissivity of the cylinder in each case of the normal and the high insulation, FIG. 14 also illustrates a high heat insulation case where the cylinder wall thickness is increased and its material is changed and a higher heat insulation case where air insulation is performed with high performance.

Further, in the embodiment, the description has been given of the W/Js 501A and 501B corresponding to the cooling medium passages. However, the present invention is not limited to this. For example, the cooling medium passage may have a spiral shape, around the cylinder, extending from the upper portion, at the exhaust side, of the cylinder wall surface of the cylinder block toward the lower portion of the cylinder. In this case, the upper portion, at the exhaust side, of the cylinder wall surface is preferentially cooled to suitably suppress the knocking. Also, in this case, the cooling medium passage branches off such that the cooling medium flows through the cylinder head after flowing through the spiral shaped portion, of the cooling medium passage, in the cylinder head. This reduces the cooling loss at the cylinder head, when the coolant flows through the cylinder head. In addition, FIG. 13 illustrates an engine 50A' as a reference.

Further, it is reasonable that various portions are functionally achieved by the ECU 70 mainly controlling the engine 50 in the above embodiments. For example, the various portions may be achieved by hardware such as another electronic controller, an exclusive electronic circuit, or any combination thereof. Furthermore, for example, the various portions may be achieved, as a distributed control portion, by hardware such as plural electronic controllers and plural electronic circuits or a combination of hardware such as an electronic controller and an electronic circuit.

DESCRIPTION OF LETTERS OR NUMERALS

1 cooling device
11 W/P
12 radiator
13 thermostat
14 flow rate control valve
21 opening and closing valve
50 engine
501 W/J
51A, 51B cylinder block
51*a* cylinder
52 cylinder head
52*a* inlet port
52*b* exhaust port
70 ECU

The invention claimed is:

1. An engine cooling device comprising:

an engine provided with a cylinder block, a cylinder head, and a cooling medium flow passage which is a single system as a whole and which causes a cooling medium to flow from the cylinder block to the cylinder head, wherein the cooling medium flow passage branches into at least two inner paths within the cylinder block, and the inner paths are joined together within the cylinder head, wherein the inner paths that are joined together within the cylinder head are first joined at a joining point that is at an outlet portion of the cooling medium inside the cylinder head, a switching portion that is provided to at least one of the inner paths, and permits or prohibits flow of the cooling medium through based on a pressure of the cooling medium which is a state quantity that is used for estimating an increase in the temperature of the cylinder, the switching portion increases a flow rate of the cooling medium by permitting the flow of the cooling medium, when the state quantity indicates that the temperature of the cylinder head is higher than the first predetermined temperature, a cooling medium pressure-feeding portion to change the flow rate of the cooling medium that is pressure-fed, and a control portion that controls the cooling medium pressure-feeding portion to increase the flow rate of the cooling medium pressure that is pressure-fed as the temperature of the cylinder head increases, based on the temperature of the cylinder head.

2. The engine cooling device of claim 1, wherein the control portion is configured to perform flow rate increase control to control the cooling medium pressure-feeding portion to increase the flow rate of the cooling medium that is pressure-fed, when the temperature of the cylinder head is higher than a second predetermined temperature which is higher than the first predetermined temperature, and a warning portion is provided to be configured to perform control to output a warning of abnormality, when the temperature of the cylinder head is not lower than the second predetermined temperature after the control portion performs the flow rate increase control.

3. The engine cooling device of claim 2, further comprising an output limiting portion configured to perform control to limit an output of the engine, when the temperature of the cylinder head is not lower than the second predetermined temperature after the control portion performs the flow rate increasing control.

4. The engine cooling device of claim 1, wherein the cooling medium flow passage is provided such that an exhaust side is cooled in preference to an intake side of the cylinder block, the cooling medium flow passage branches from a downstream side of at least at the exhaust side in the cylinder block, and the flow changing portion is provided in the inner path including its portion provided at the intake side in the cylinder block.

5. The engine cooling device of claim 1, wherein the switching portion includes a valve that is openable and closeable.

6. The engine cooling device of claim 1, wherein the cooling medium pressure-feeding portion includes a pump to change the flow rate of the cooling medium that is pressure-fed.

* * * * *